United States Patent [19]

Suzuki et al.

[11] Patent Number: 4,521,133

[45] Date of Patent: Jun. 4, 1985

[54] CAISSON FOR UNDERWATER STRUCTURES

[75] Inventors: Shoichi Suzuki, Hiratsuka; Wataru Ohta, Ninomiyamachi; Noriaki Sakurai, Kurashiki; Michio Yamashita, Fukuyama, all of Japan

[73] Assignee: The Yokohama Rubber Co., Ltd., Tokyo, Japan

[21] Appl. No.: 443,109

[22] Filed: Nov. 19, 1982

[30] Foreign Application Priority Data

Nov. 20, 1981 [JP] Japan ..... 56-172151[U]

[51] Int. Cl.[3] ..... E02D 23/16; E02D 27/18; E02D 27/52

[52] U.S. Cl. ..... 405/195; 405/229

[58] Field of Search ..... 405/8, 11–14, 405/16, 18, 19, 189, 195, 211, 210, 215, 229, 224; 114/227–229; 52/169.5, 169.9

[56] References Cited

U.S. PATENT DOCUMENTS

| | | | |
|---|---|---|---|
| 381,302 | 4/1888 | Weihe | 114/229 |
| 387,200 | 7/1888 | Schultz | 114/229 |
| 569,430 | 10/1896 | Schroeder | 114/229 |
| 2,508,078 | 5/1950 | Rowley | 114/227 |
| 3,485,056 | 12/1969 | Helmus | 405/189 |
| 3,791,443 | 2/1974 | Burt et al. | 405/229 X |

FOREIGN PATENT DOCUMENTS

| | | | |
|---|---|---|---|
| 27378 | of 1902 | United Kingdom | 114/229 |
| 1081670 | 8/1967 | United Kingdom | 114/229 |

*Primary Examiner*—Cornelius J. Husar
*Assistant Examiner*—Nancy J. Stodola
*Attorney, Agent, or Firm*—Armstrong, Nikaido, Marmelstein & Kubovcik

[57] ABSTRACT

A caisson for an underwater structure is provided comprising an elongated sponge mat fitted along the outer edge of the base of the frame, said sponge mat being molded from a plastic material and having a skin of a dense foam structure and an interior of a coarse foam structure, a plurality of small holes being provided in said sponge mat so as to extend crosswise, or transversely to the longitudinal direction of the mat, from one side of the mat to the other side, and at least one rope being passed through each of said holes, each of said ropes being of a length equal to or greater than the length of the corresponding small hole.

8 Claims, 4 Drawing Figures

CAISSON FOR UNDERWATER STRUCTURES

BACKGROUND OF THE INVENTION

This invention relates to a caisson for sealing the spaces between the underside of the frame of an underwater structure and the bedrock.

For instance, when building a structure such as a pier supporting a bridge across a channel on bedrock under water, spaces are created between the underside of the frame of the structure and the bedrock surface due to the roughness of the bedrock surface. Therefore, if underwater concrete such as prepacked concrete is placed in the frame under this condition, mortar will leak out from said spaces to cause the wastage of mortar as well as the contamination of the water. Hitherto, in order to prevent such leakage of mortar, it has been a common practice to lay elastic sponge mats along the outer edges of the base of the frame to seal the spaces.

These sponge mats are usually molded from a foamed plastic such as polyurethane rubber so that the interior of the mat has a coarse foam structure but the skin has a dense foam structure which has a relatively low water permeability. Therefore, if a sponge mat of such a structure is sunk under water along with the frame, since water is unable to penetrate into the mat quickly, the sponge mat is compressed by the water pressure and becomes unable to perform its intended function of sealing the spaces between the base of the frame and the bedrock. In order to solve this problem, it has been proposed to provide a plurality of small holes in the skin of the mat which extend into the inner coarse structure.

The provision of such small holes in the skin of the sponge mat allows the relatively easy penetration of water into the mat. However, when the base of the frame touches the bedrock surface and compresses the sponge mat, since such compression is effected rapidly in a short time and the small holes in the skin are collapsed and blocked, water which has penetrated into the mat can not find its way out and is trapped inside the mat. Consequently, the sponge mat swells out sidewise under the high internal water pressure, and when its deformation exceeds the limits of endurance, the mat bursts. When such damage is extensive, the sponge mat becomes unable to perform its function satisfactorily as a seal. The risk of occurrence of such damage is large when the penetration rate of water into the sponge mat is extraordinarily high as often experienced in construction work in deep water, or when the compressibility of the mat is extremely high because of the enlarged size of the mat.

SUMMARY OF THE INVENTION

An object of this invention is to provide a caisson for an underwater structure with an excellent sealing performance.

Another object of this invention is to provide a caisson for an underwater structure which is of a construction which allows the rapid penetration of water into the sponge mat, and which also facilitates the discharge of water when the mat is compressed between the frame and the bedrock to thereby eliminate the risk of the mat bursting.

Still another object of this invention is to provide a caisson for an underwater structure which is so constructed as to prevent the sponge mat from being burst easily even in deep water construction work or when large-sized sponge mats are used.

In order to accomplish the above objects, according to this invention a caisson is provided for an underwater structure, comprising: an elongated sponge mat designed to be laid along the outer edge of the base of a frame, said sponge mat being molded from a plastic material and having a dense foam structure at its skin and a coarse foam structure in its interior; a plurality of small holes provided in said sponge mat such that said holes extend crosswise (transversely to the longitudinal direction of the mat) from one side of the mat to the other; and at least one rope passed through each of said small holes, each rope having a length equal to or greater than the length of the corresponding small hole.

Other objects and advantages of this invention will become apparent as the invention is described more fully below by way of embodiments thereof with reference to the accompanying drawings.

DESCRIPITON OF THE PREFERRED EMBODIMENTS

Figure 1:
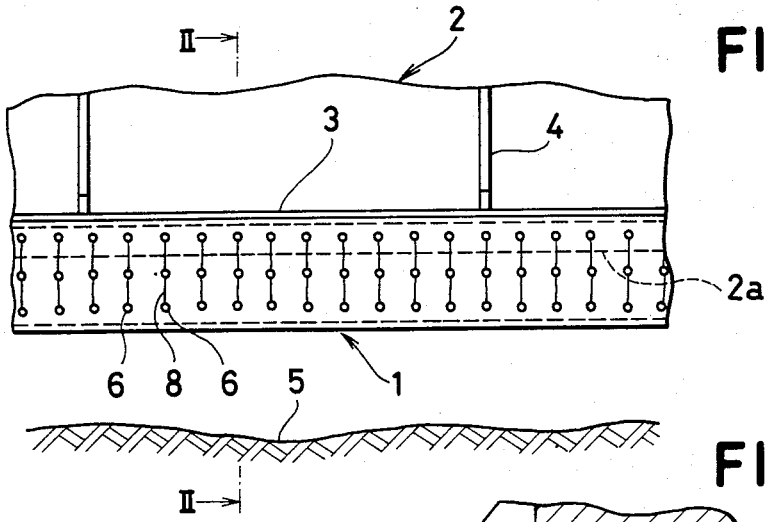
FIG. 1 is a side elevational view of the caisson in accordance with an embodiment of this invention, said caisson being shown when not compressed.
Figure 2:
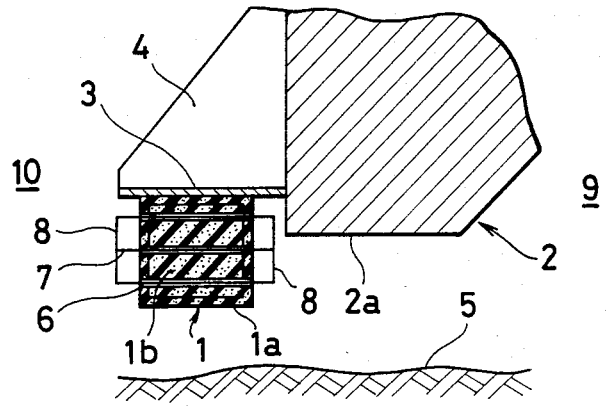
FIG. 2 is a sectional view taken along the line II—II of FIG. 1.

FIGS. 1 and 2 show the situation when the caisson for an underwater structure is just about to land on bedrock under water. In the drawings, numeral 1 indicates a sponge mat, 2 the frame of an underwater structure, and 5 the bedrock. A mounting flange 3 is welded to the side of the frame 2 corresponding to the outer edge of its base, the mounting flange extends horizontally at a level higher than the under-surface 2*a* of said frame 2, said flange 3 being reinforced by ribs 4. The top surface of the sponge mat 1 is secured to the underside of said flange 3. Said sponge mat 1 is of an elongated configuration so as to encompass the outer edge of the base of the frame 2. Numeral 9 indicates the interior of the frame 2 and numeral 10 the exterior thereof. Mortar is poured into the interior 9 of the frame 2.

The sponge mat 1 is molded from a foamed plastic material such as polyurethane rubber, and thus it consists of a skin 1*a* with a dense foam structure and an interior 1*b* with a coarse foam structure. The thickness of the skin 1*a* is of the order of 5 to 10 mm. Such a sponge mat 1 is preferably one which has an apparent specific gravity of 0.25 to 0.35, a compression strength at 70% compression of 2 to 5 kg/cm$^2$, and a standard maximum compression strain of 70 to 80%. Said sponge mat 1 is provided with a plurality of small holes 6 which extend crosswise, or transversely to the length of the mat 1, through the skin 1*a* and interior 1*b* of the mat. Thus, each of said small holes 6 opens at one end to the interior 9 of the frame 2 and at the other end to the exterior 10 of the frame 2. At least one rope 7 is passed through each of said small holes 6 from one end thereof to the other end. Each rope 7 is of a length equal to or greater than the length of the equivalent small hole 6, and each end of said ropes 7 is connected by a connecting rope 8 to the end of another rope 7 passed through another small hole 6 so that all the ropes are formed into loops. Instead of connecting the ends of the ropes 7 in adjacent holes 6 by a connecting rope 8, said ropes 7 may be directly joined endwise to each other, or may be joined together by a metal fitting or other suitable means. Also, the ends of the ropes 7 could be left free without being joined to each other.

The ropes 7 are preferably made of a synthetic fiber such as a polyamide, polyester, polypropylene, polyethylene, polyvinyl alcohol or the like, or a natural fiber such as cotton, flax or the like. It is desirable to pass one to at most ten ropes 7 through each small hole 6. Each of such ropes 7 is preferably of a diameter of 2 to 20 mm. The diameter of each small hole 6 is between 5 and 20 mm, and a plurality of such small holes 6 are preferably distributed along both the lengthwise and the vertical directions of the mat 1 at a pitch of 50 to 300 mm.

Figure 3:
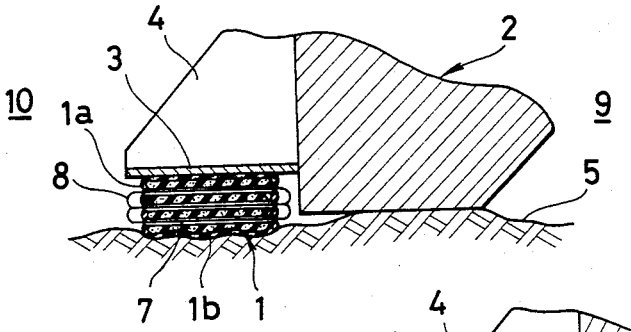
FIG. 3 is a sectional view similar to FIG. 2 but showing the caisson when compressed.
Figure 4:
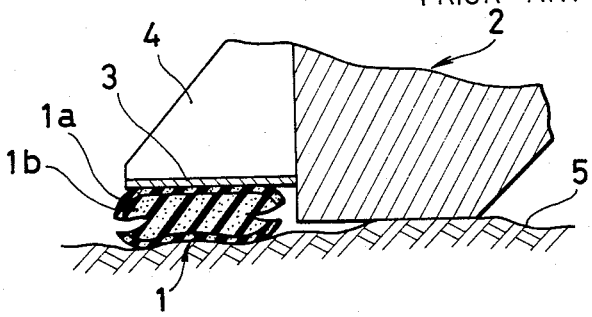
FIG.4 PRIOR ART
FIG. 4 is a similar sectional view of a prior art caisson when compressed.

When the above caisson is sunk under water, water is allowed to penetrate sufficiently into the mat 1 in a short time through said plurality of small holes 6 provided in the mat 1, so that there is no fear of the volume of the mat being reduced by water pressure. When the bottom of the frame 2 lands on the bedrock 5 as shown in FIG. 3, the sponge mat 1 is compressed between the mounting flange 3 and the bedrock 5. However, since rigid ropes 7 are passed through each of the small holes 6, said holes 6 do not collapse easily under the compression, allowing the smooth drainage of the water from the interior of the mat, and hence there is no chance of water being trapped in the mat to raise the water pressure therein. When the sponge mat 1 is compressed, the water in the mat is discharged through the spaces around each rope 7 in each hole 6, or between adjoining ropes when two or more ropes are placed in each hole 6. Therefore, there is no risk of the sponge mat 1 being burst by a rise in the pressure of the trapped water. Further, each rope 7 produces a frictional resistance along the inner surface of each small hole 6 to reduce stretch deformation toward the free surface of the sponge mat 1. Thus, any possible stretch deformation of the sponge mat 1 in the sidewise direction can be restricted within the limits of the burst endurance of the mat to make the mat even less likely to burst. In the prior art sealing structure, as shown in FIG. 4, water tends to be trapped in the sponge mat 1 and also there is no force acting to suppress the stretch deformation in the sidewise direction of the mat, making the mat liable to burst. Such a risk of bursting is eliminated in the above sealing structure according to this invention.

When the ends of the ropes 7 passed through the small holes 6 are joined to form loops, even if deformation of the mat 1 occurs in the sidewise direction due to the sliding of the ropes through the small holes, such deformation is restricted by the loops to make the mat even more resistant to bursting. These loops may also be designed so that even if the sponge mat 1 does burst if it receives an unexpectedly rapid, high-pressure compression deformation, the broken pieces of the loops will not be separated so as to minimize the reduction of the sealing performance of the mat.

As described above, the caisson for an underwater structure according to this invention allows the quick penetration of water into the sponge mat as well as the smooth discharge of water when the mat is compressed between the frame and the bedrock so that said seal can eliminate the risk of bursting of the sponge mat while performing an excellent sealing function. The caisson of this invention proves particularly effective for deep water construction work or when large-sized sponge mats are used. Thus, when using the caisson according to this invention, there is no likelihood that mortar placed in the frame should leak out of the frame, thus preventing the loss of the mortar and the contamination of the water.

What is claimed is:

1. A caisson for an underwater structure designed to seal the space between the underside of a frame and bedrock underwater, comprising:

an elongated sponge mat positioned along the outer edge of the base of said frame and arranged to be compressed between a portion of said frame and said bedrock, said sponge mat being molded from a plastic material and comprising a skin of a dense foam structure and an interior of a coarse foam structure;

a plurality of small holes in said sponge mat for admitting water to said interior coarse foam structure, said holes extending crosswise from one side of said mat to the other side through said skin and said interior coarse foam structure, and at least one rope passing through each of said small holes and serving to prevent collapse of said holes when said mat is compressed and allow drainage of water from said interior coarse foam structure of said mat, each of said ropes having a length equal to or greater than the length of its corresponding small hole.

2. A caisson for an underwater structure according to claim 1, wherein said sponge mat has an apparent specific gravity of 0.25 to 0.35, a compression strength at 70% compression of 2 to 5 kg/cm$^2$ and a standard maximum compression strain of 70 to 80%.

3. A caisson for an underwater structure according to claim 1, wherein said ropes are made of a fiber selected from the group consisting of synthetic fiber and natural fiber.

4. A caisson for an underwater structure according to claim 1, wherein said ropes have a diameter of 2 to 20 mm, and between one and ten of said ropes are provided in each of said small holes.

5. A caisson for an underwater structure according to any one of claim 1, 3, or 4, wherein one end of each of said ropes is joined to the corresponding end of another of said ropes.

6. A caisson for an underwater structure according to claim 1, wherein said small holes are arranged at a pitch of 50 to 300 mm and have a diameter of 5 to 20 mm.

7. A caisson for an underwater structure according to claim 1, wherein said frame includes a mounting flange fixed to the side of said frame and extending horizontally at a level higher than the base of said frame and wherein said sponge mat is secured to the underside of said flange.

8. A caisson for an underwater structure according to any one of claims 1, 3 or 4 wherein the ends of said rope are free.

* * * * *